US008683910B1

(12) United States Patent
Foster

(10) Patent No.: US 8,683,910 B1
(45) Date of Patent: Apr. 1, 2014

(54) HYDRAULIC CYLINDER WITH PISTON VALVE ASSEMBLY

(75) Inventor: Tim Foster, Louisville, KY (US)

(73) Assignee: Foster Hydraulics, Inc., Louisville, KY (US)

( * ) Notice: Subject to any disclaimer, the term of this patent is extended or adjusted under 35 U.S.C. 154(b) by 584 days.

(21) Appl. No.: 12/861,809

(22) Filed: Aug. 23, 2010

Related U.S. Application Data

(60) Provisional application No. 61/235,879, filed on Aug. 21, 2009.

(51) Int. Cl.
*F01L 21/04* (2006.01)
*F15B 13/04* (2006.01)
*F01B 31/00* (2006.01)

(52) U.S. Cl.
USPC ..... 91/229; 91/422; 92/181 P

(58) Field of Classification Search
USPC ..... 91/229, 422; 92/181 P, 181 R, 183
See application file for complete search history.

(56) References Cited

U.S. PATENT DOCUMENTS 239,494 A * 3/1881 Haskin ..... 91/23
2,959,044 A 1/1961 Leduc
3,405,602 A 10/1968 Novak
3,405,699 A 10/1968 Laas
3,654,834 A 4/1972 Sifri et al.
3,735,632 A 5/1973 Hilton
3,808,946 A 5/1974 Bell et al.
4,729,283 A 3/1988 Hillier
4,825,752 A 5/1989 Kiffmeyer
4,879,943 A 11/1989 Grach
5,325,763 A 7/1994 Foster
5,425,305 A * 6/1995 Mauritz ..... 91/422
6,170,383 B1 1/2001 Mauritz
6,176,170 B1 1/2001 Uppgard et al.
6,398,527 B1 6/2002 Gramm et al.

* cited by examiner

*Primary Examiner* — Michael Leslie
(74) *Attorney, Agent, or Firm* — R. Randall Frisk

(57) ABSTRACT

A hydraulic cylinder includes a cylinder assembly having a cylinder, defining an inner hydraulic chamber and being for reciprocating receipt of a piston and piston rod therein; a piston rod extending from the inner hydraulic chamber exteriorly of the cylinder; and a piston head assembly connected with the piston rod and disposed for reciprocation within the cylinder assembly. The piston head assembly includes a piston head and a valve assembly including a passageway defined in the piston head and a valve member having an outer surface and being sized and configured for reciprocation in the passageway between extended and retracted positions therein, the valve member defining at least one flat defined along the outer surface and at least one transition surface between the outer surface and the flat, the transition surface forming an angle with the flat of less than 90 degrees.

2 Claims, 9 Drawing Sheets

HYDRAULIC CYLINDER WITH PISTON VALVE ASSEMBLY

REFERENCE TO RELATED APPLICATIONS

This application claims the benefit of the filing date of Provisional Application No. 61/235,879, filed Aug. 21, 2009, all of which is hereby incorporated by reference.

FIELD OF THE INVENTION

The present invention relates to the field of hydraulic cylinders, and more specifically, to a hydraulic cylinder with a piston valve assembly providing variable force output.

BACKGROUND OF THE INVENTION

In some hydraulic cylinders, the limit of stroke in at least one direction is defined when the piston head strikes the cylinder end cap or gland. Particularly in equipment where such cylinders are high pressure, double-acting cylinders cycled thousands of times, the resulting premature wear and damage to the cylinder is a problem. Improvements in such cylinders to lessen the wear and damage are continually being sought.

SUMMARY OF THE INVENTION

Generally speaking, a piston in a double acting hydraulic cylinder includes an automatic valve assembly for reducing the end stroke impact of the piston against the cylinder ends.

A hydraulic cylinder includes a cylinder assembly having a cylinder, defining an inner hydraulic chamber and being for reciprocating receipt of a piston and piston rod therein; a piston rod extending from the inner hydraulic chamber exteriorly of the cylinder; and a piston head assembly connected with the piston rod and disposed for reciprocation within the cylinder assembly. The piston head assembly includes a piston head and a valve assembly including a passageway defined in the piston head and a valve member having an outer surface and being sized and configured for reciprocation in the passageway between extended and retracted positions therein, the valve member defining at least one flat defined along the outer surface and at least one transition surface between the outer surface and the flat, the transition surface forming an angle with the flat of less than 90 degrees.

It is an object of the present invention to provide an improved bi-directional hydraulic cylinder.

Further objects and advantages of the present invention will become apparent from the following description of the preferred embodiment

DESCRIPTION OF THE PREFERRED EMBODIMENT

Figure 1:
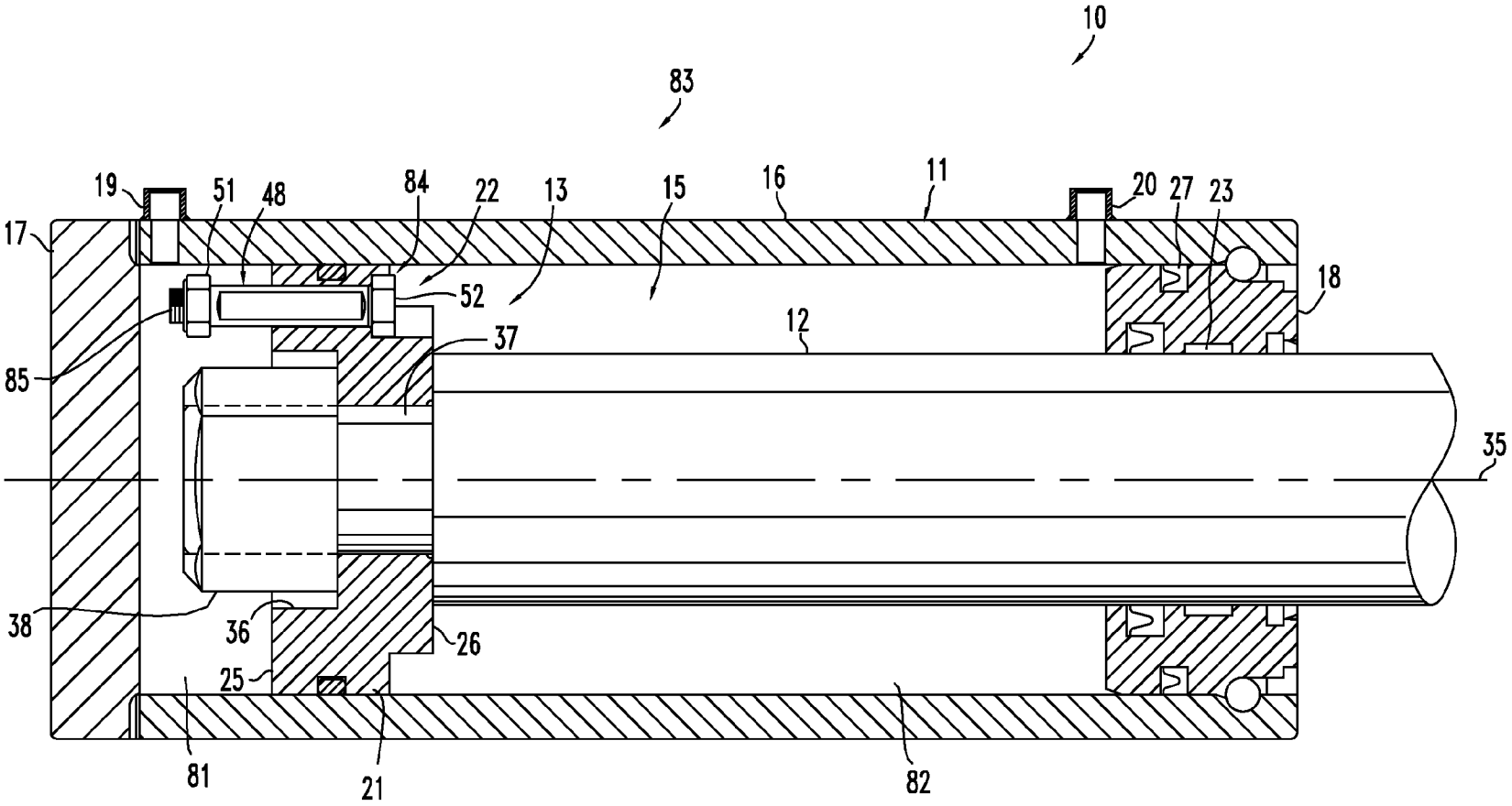
FIG. 1 is a side, cross-sectional view of a hydraulic cylinder 10 with piston valve assembly in accordance with one embodiment of the present invention, and showing the hydraulic cylinder 10 in the forward biased condition 83.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Referring to FIG. 1, there is shown a hydraulic cylinder 10 with piston valve assembly in accordance with one embodiment of the present invention. Hydraulic cylinder 10 is particularly adapted for use in bi-directional cylinders, but alternative embodiments are contemplated wherein the valve assembly is used in single acting hydraulic cylinders. Hydraulic cylinder 10 generally includes a cylinder assembly 11, a piston rod 12 and a piston head assembly 13. Cylinder assembly 11 includes a cylinder 16, an end cap 17, a gland 18 and various seals and wear rings (e.g. at 23 and 27) to provide fluid tight seals therein, as is known in the industry. Cylinder assembly 11 defines an inner hydraulic chamber 15 which is divided by the piston rod 12 and piston head assembly 13 into forward and rearward chambers 81 and 82. Forward and rearward input ports 19 and 20 provide for the entry and exit of hydraulic fluid to the opposing forward and rearward chambers 81 and 82, as described herein.

Figure 5:
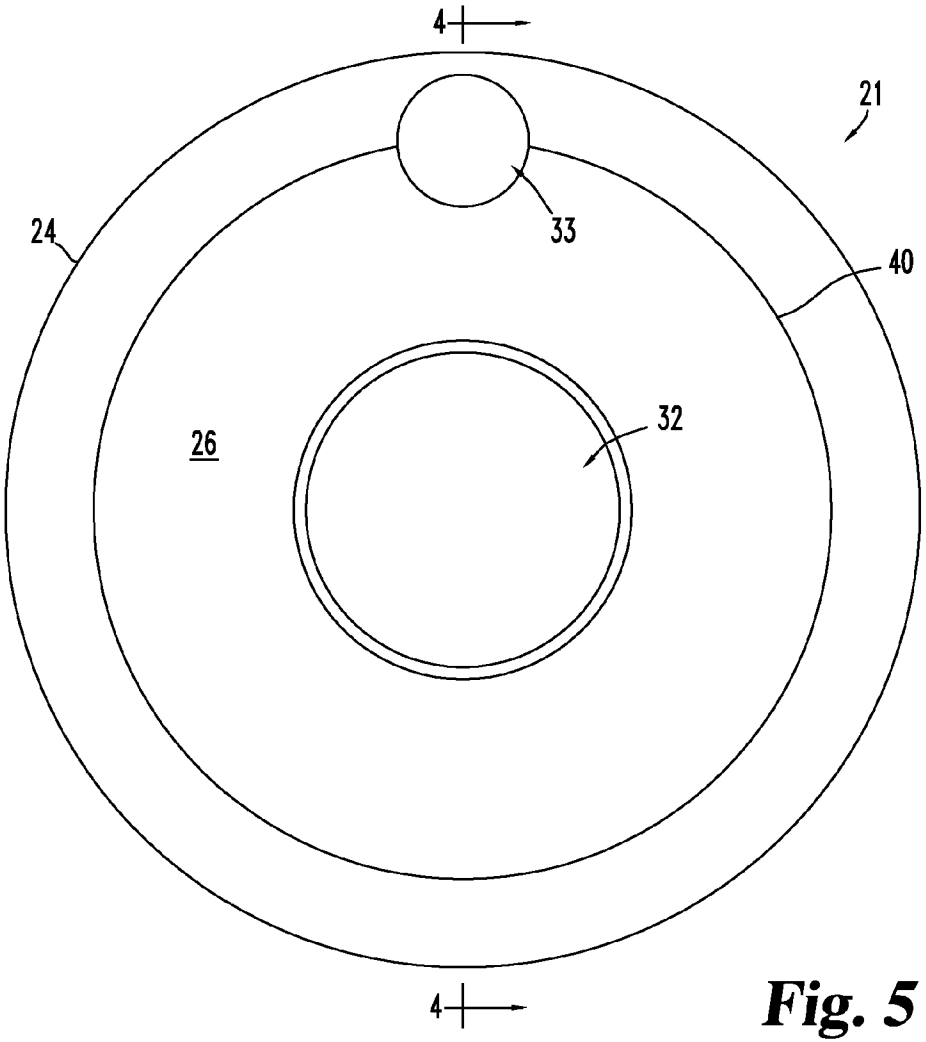
FIG. 5 is a top view of the piston head 21 of the hydraulic cylinder 10 of FIG. 1.
Figure 4:
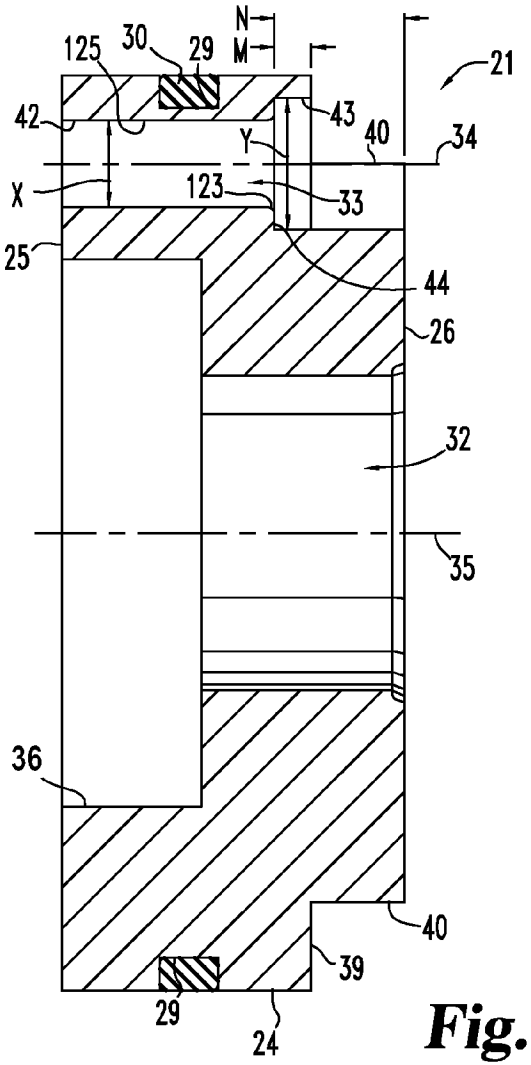
FIG. 4 is side, cross-sectional view of the piston head 21 of FIG. 5 viewed along the line 4-4 and viewed in the direction of the arrows.

Referring to FIGS. 1, 4 and 5, piston head assembly 13 includes a piston head 21 and a valve assembly 22. Piston head 21 has a round cross-section sized to be received and reciprocate within cylinder 16. Piston head 21 has an outer cylindrical surface 24, a front face 25, and a rear face 26. Defined in the outer cylindrical surface 24 of piston head 21 is a circumferential groove 29 for receiving a seal 30. Piston head 21 also defines a central, axial bore 32 and a valve passageway 33 with an axis 34 which, in the present embodiment, is parallel to the axis 35 of piston head 21 and cylinder 16. Extending inwardly from its front face 25, piston head 21 also defines a forward counterbore 36. The forward, reduced diameter end 37 of piston rod 12 extends through central bore 32 of piston head 21, and a nut 38 is threadedly received thereon to tightly secure head 21 to the forward end of piston rod 12. A portion of nut 38 sits within counterbore 36, and a portion thereof extends forwardly of the front face 25 of head 21. The limits of movement of rigidly connected piston head 21 and piston rod 12 are defined forwardly by nut 38 contacting end cap 17 and rearwardly by rear face 26 contacting gland 18. From its rear face 26, piston head 21 has a reduced diameter for a portion of its axial length, which forms a rear ledge 39 and a ledge cylindrical surface 40.

Valve passageway 33 has a main bore 42 with a diameter X and, at its rear end, a counterbore 43 with a diameter Y. Counter bore 43 opens to both rear face 26 and rear ledge 39. The bottom 44 of counter bore 43 is recessed forwardly of rear ledge 39 a distance M and forwardly of rear face 26 a distanced N.

Figure 3A:
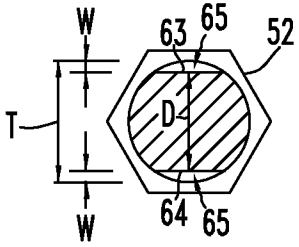
FIG. 3*a* is a cross-sectional view of the shank 50 of FIG. 3 taken along the lines 3*a*-3*a* and viewed in the direction of the arrows.
Figure 2:
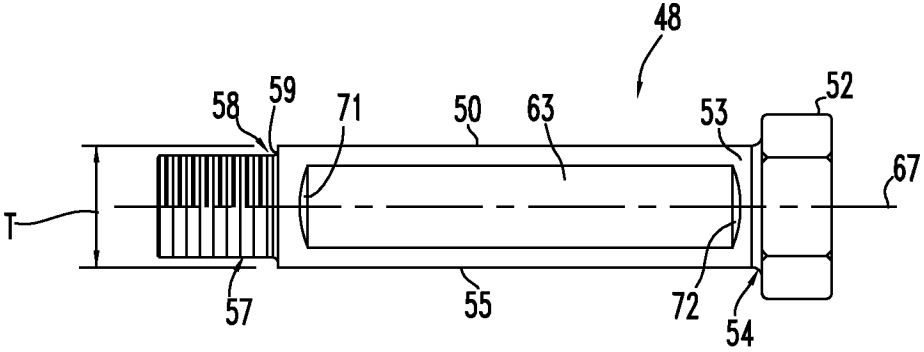
FIG. 2 is a side view of the shank 50 and rearward head 52 of the valve member 48 of valve assembly 22 of the apparatus 10 FIG. 1.
Figure 3:
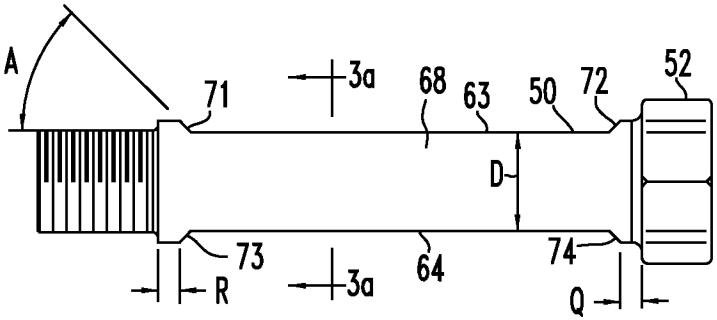
FIG. 3 is a side view of the shank 50 and rearward head 52 of FIG. 2, and shown rotated 90 degrees about its axis 67.

Referring to FIGS. 1-3, valve assembly 22 includes a valve member 48 and the valve passageway 33. Valve member 48 includes a central shank 50, a forward head 51 and a rearward head 52. Shank 50 has a generally round cross-section body 55 with a diameter T just slightly smaller (in one embodiment, about 0.005 inches in diameter) than the diameter X of valve passageway 33 so that shank 50 can freely slide therewithin. At its rearward end 53, shank 50 is rigidly connected with rearward head 52. The junction 54 between shank 50 and rearward head 52 forms not an abrupt 90 degree corner, but is instead slightly radiused, which contributes to a better seal between valve member 48 and piston head 21. The forward end 57 of shank 50 is reduced in diameter and is threaded, and the junction 58 between the cylindrical body 55 and the threaded portion 57 forms a ledge 59. Forward head 51 is a nut (51) threadedly received onto forward end 57 and securely against ledge 59. In one embodiment, nut (51) is a 5/16"-18 UNF vinyl insert lock nut, shank diameter T is 0.370 inches, and main bore diameter X is 0.375 inches. Other dimensions are contemplated as would provide the desired variable piston force and cushioning characteristics. Also in this embodiment, shank 50 and rearward head 51, in assembly, form a fixed unit with the forward head 51 comprising a separate element (nut 51) secured on the forward end 57 of shank 50 in a manner suitable to prevent the nut (51) from being vibrated loose or off shank 50 from the continual reciprocation of valve member 48. Alternative embodiments are contemplated wherein the forward and rearward heads of valve member 48 include both heads 51 and 52 comprising separate pieces, such as a nut (51).

Figure 9:
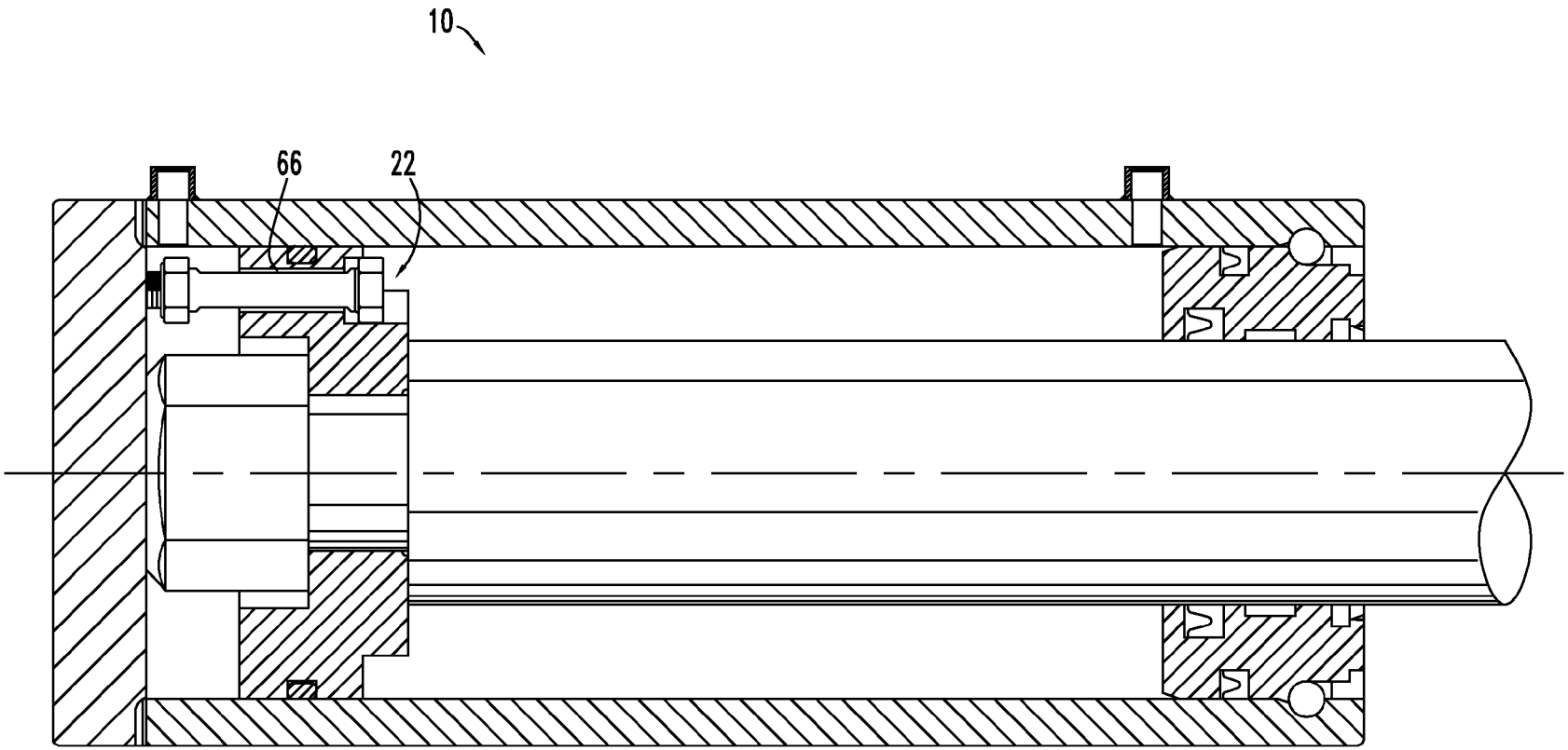
FIG. 9 is a side, cross-sectional view of the hydraulic cylinder 10 of FIG. 7 and showing valve member 48 turned 90 degrees about its axis 67.

As shown in FIGS. 2, 3 and 3*a*, shank 50 is not entirely round in cross-section. A portion of shank 50 is removed (or shank 50 is formed) to define opposing flats 63 and 64 that extend from just rearwardly of forward junction 58 and to just forwardly of rearward junction 54. Flats 63 and 64 are planar and parallel with each other and, in one embodiment, the shortest distance D between flats 63 and 64 is 0.28 inches; the shank diameter T is 0.37 inches; and, the resulting difference therebetween creates opposing pressure relief channels 65 each having a maximum depth W. This forms opposing gaps 66 (FIG. 9) of about 0.047 inches between each flat 63/64 and main bore 42 ((main bore diameter X (0.375 inches)−thickness D (0.28 inches))/2). The gap distances W of relief channels 65 of flats 63 and 64 are identical; flats 63 and 64 are each planar; and flats 63 and 64 are symmetrical about a plane passing through the shank axis 67. Alternative embodiments are contemplated wherein flats 63 and 64 may be non planar (e.g. curved) and/or not symmetrical about a plane passing through the shank axis 67.

The junctions between each flat 63/64 and the cylindrical body 55 form forward and rearward transition surfaces 71 and 72 (flat 63) and 73 and 74 (flat 64). In one embodiment, each transition surface 71-74 forms a transition angle A between about 40 and 50 degrees with its adjacent flat (63/64), and preferably the transition angle A is about 45 degrees. Transition surfaces 71-74 (1) reduce impact stresses exerted upon valve member 48 from high force, repetitive impacts, thus reducing the incidence of mechanical failure at the junctions between shank 50 and heads 51 and 52, and (2) soften the impact force, and thus force curve, particularly at the moment of valve closing. The distances Q and R of the transition surface from junctions 54 and ledge 59, respectively, may be selected to be any value providing the desired force curve output. In one embodiment where the shank diameter T is about 0.37 inches, W is about 0.044 inches and the transition angle A is 45 degrees, Q and R are both about 0.07 inches. Alternative embodiments are contemplated wherein distances Q and R (or other companion parameters, such as the transition angles A at 71 and 72) may not be identical or symmetrical with each other), for example, to compensate for varying force applications for hydraulic cylinder 10, that is, where the resistance to output force of piston rod 12 is greater in one direction than in the other.

It is noted that the relief channels created by flats 63 and 64 can be created by alternative configurations milled or defined in shank 50. That is, the deviation from a round cross-section may be created in ways other than one or more flat surfaces. It is desired, however, that in one embodiment, the structure removed from or absent from a cylindrical profile of shank 50 be as near to cylindrical as possible so as to maintain as much structural integrity as possible. Also, the surfaces 63 and 64 need not be flat. Instead, they could have a convex, concave, rippled or other profile and still provide the desired gap 66 when assembled within main bore 42. Also, there may be only one or more than two gaps 66 created. It is believed that the flat surfaces at 63 and 64 provide the optimum operating performance.

Alternative embodiments are contemplated wherein there are more than one valve assemblies 22 defined in the piston 21 to provide a different operating profile.

The length of each flat (i.e. between transition surfaces such as 71 and 72) can vary, but must be at least long enough to permit fluid flow through the corresponded gap 66 when the valve member 48 is between its extended and retracted positions.

In assembly, a forward hydraulic chamber 81 is defined by cylinder 16, end cap 17, piston head 21, piston rod 12, and valve member 48. A rear hydraulic chamber 82 is defined by cylinder 16, gland 18, piston head 21, piston rod 12, and valve member 48.

In FIG. 1, hydraulic cylinder 10 is shown in a forward biased condition 83 wherein the fluid pressure is higher in rear hydraulic chamber 82 than in forward hydraulic chamber 81, which fluid pressure bears against head 52, which seats against bottom 44 of counter bore 43, and valve member 48 is thus biased to a forward closed position 84.

Figure 6:
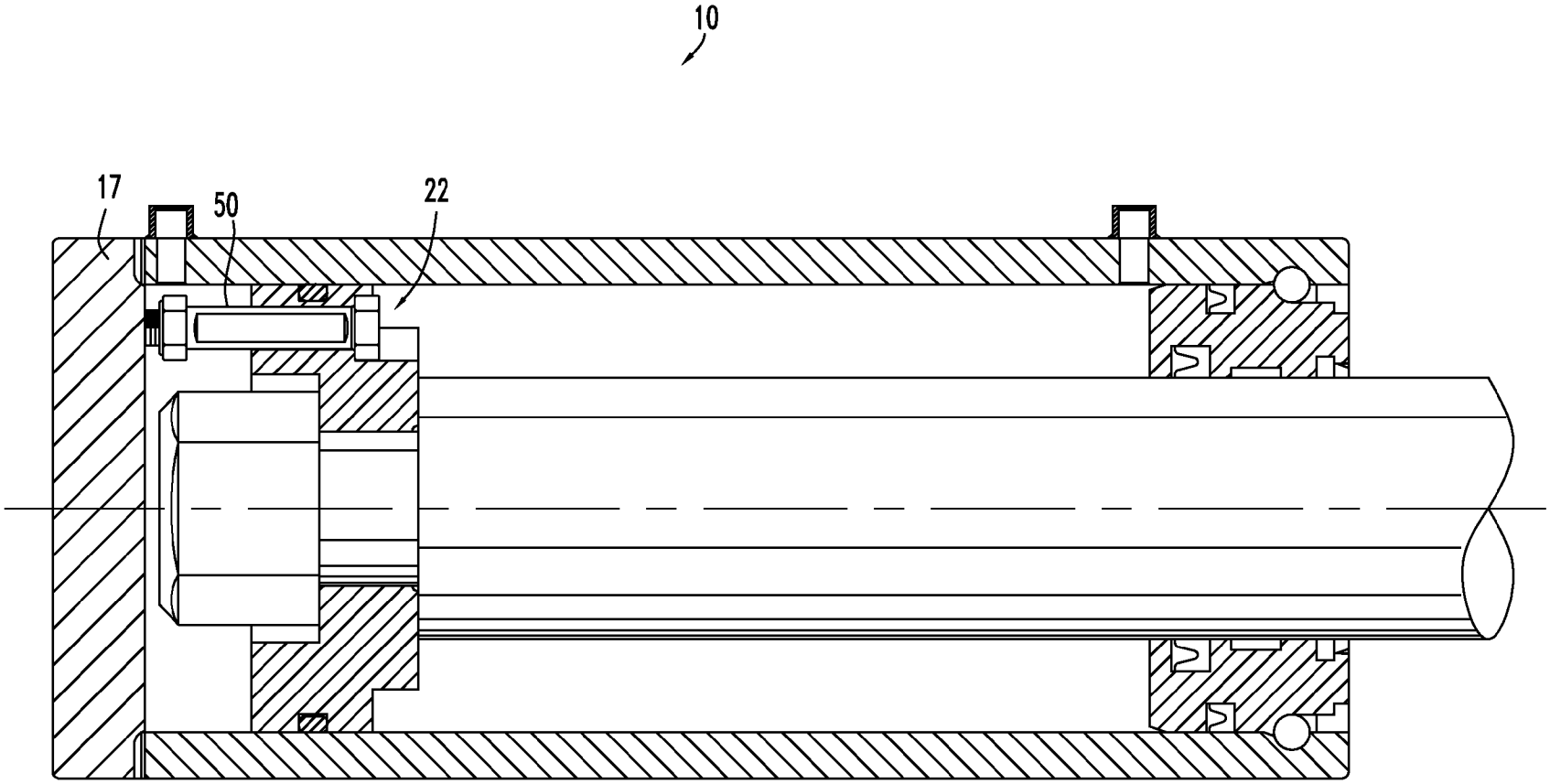
FIG. 6 is a side, cross-sectional view of the hydraulic cylinder 10 of FIG. 1 and shown biased forwardly with shank 50 just making contact with end cap 17.
Figure 7:
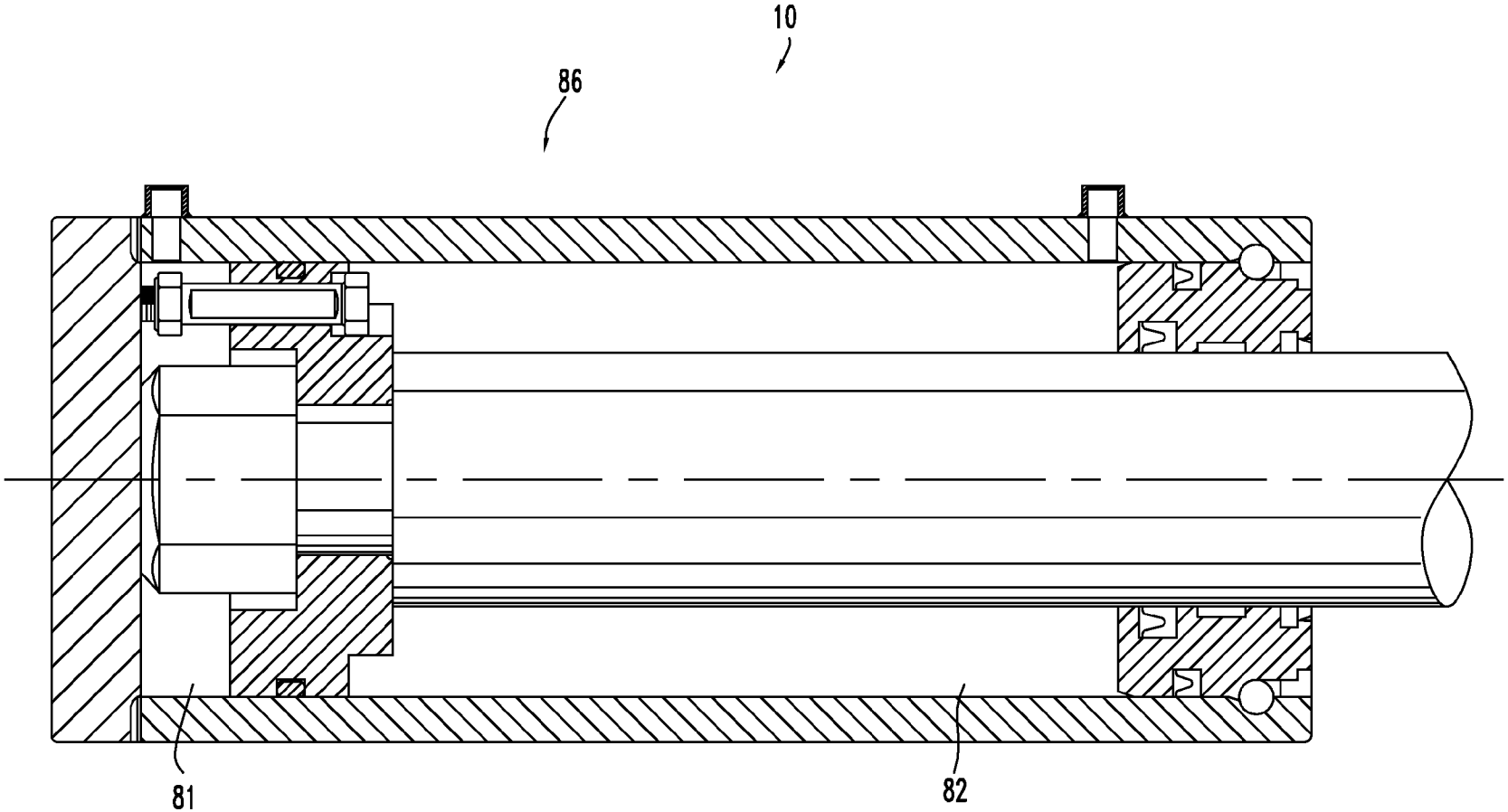
FIG. 7 is a side, cross-sectional view of the hydraulic cylinder 10 of FIG. 1 and shown in the fully retracted (forward) condition 86.

The greater pressure in chamber 82 also bears against piston head 21 and moves head 21, rod 12 and valve member 48 toward end cap 17. FIG. 6 shows hydraulic cylinder 10 just as the leading end 85 of shank 50 contacts end cap 17 and can move forwardly no farther. The next infinitesimal forward movement of piston rod 12 and piston head 21 unseats rearward head 52 from piston head 21, and fluid is permitted to flow through valve passageway 33, thus greatly reducing the motive force against the rear face 26 of piston head 21 before it contacts end cap 17, as shown with hydraulic cylinder 10 in the fully retracted (forward) condition 86 (FIG. 7). The impact force of head 21 against end cap 17 is thus greatly reduced.

Figure 8:
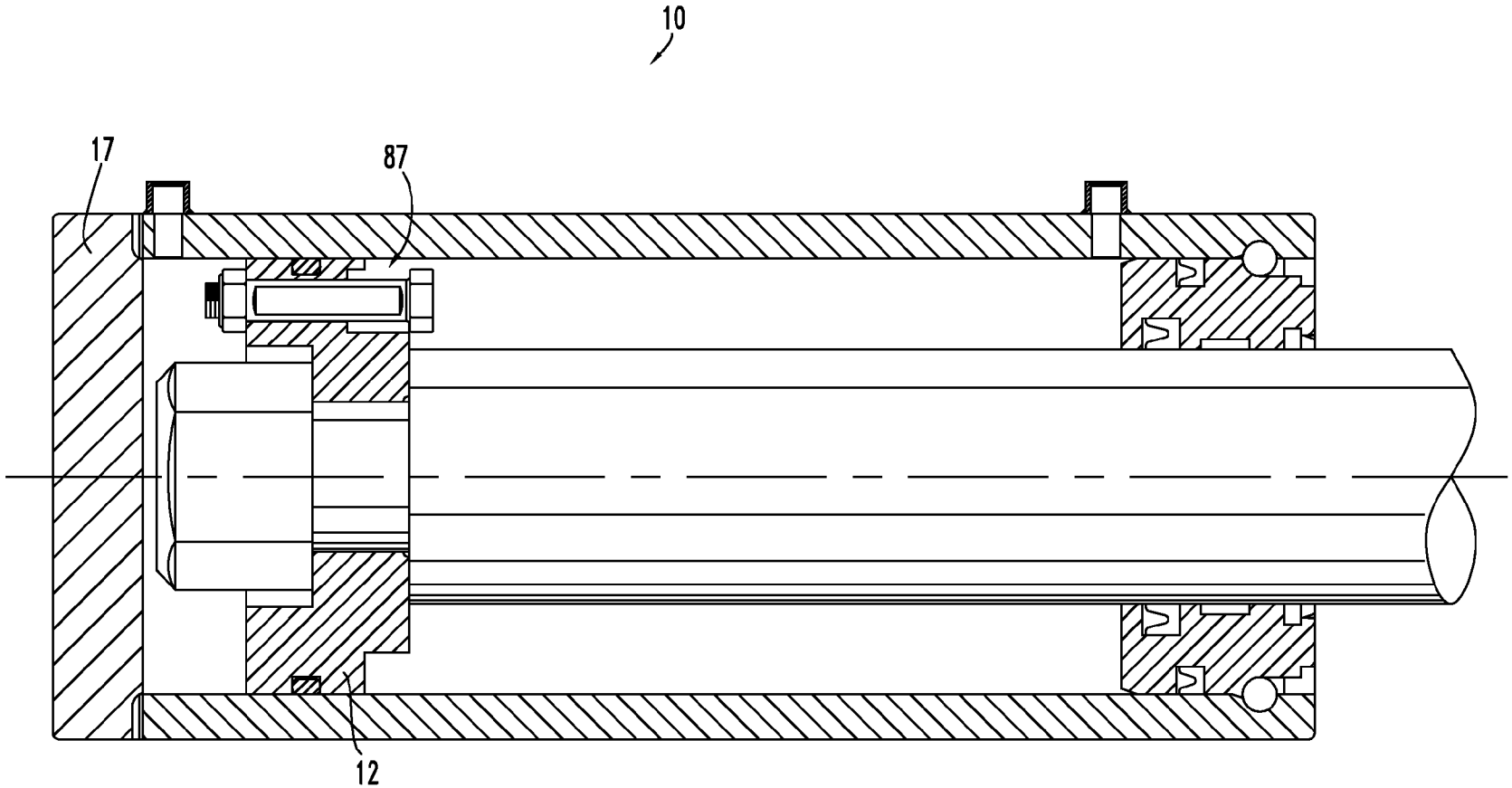
FIG. 8 is a side, cross-sectional view of the hydraulic cylinder 10 of FIG. 1 and shown with piston head 21 piston rod 12 biased rearwardly and moved slightly away from end cap 17 and valve member 48 in the rearward, closed position 87.
Figure 10:
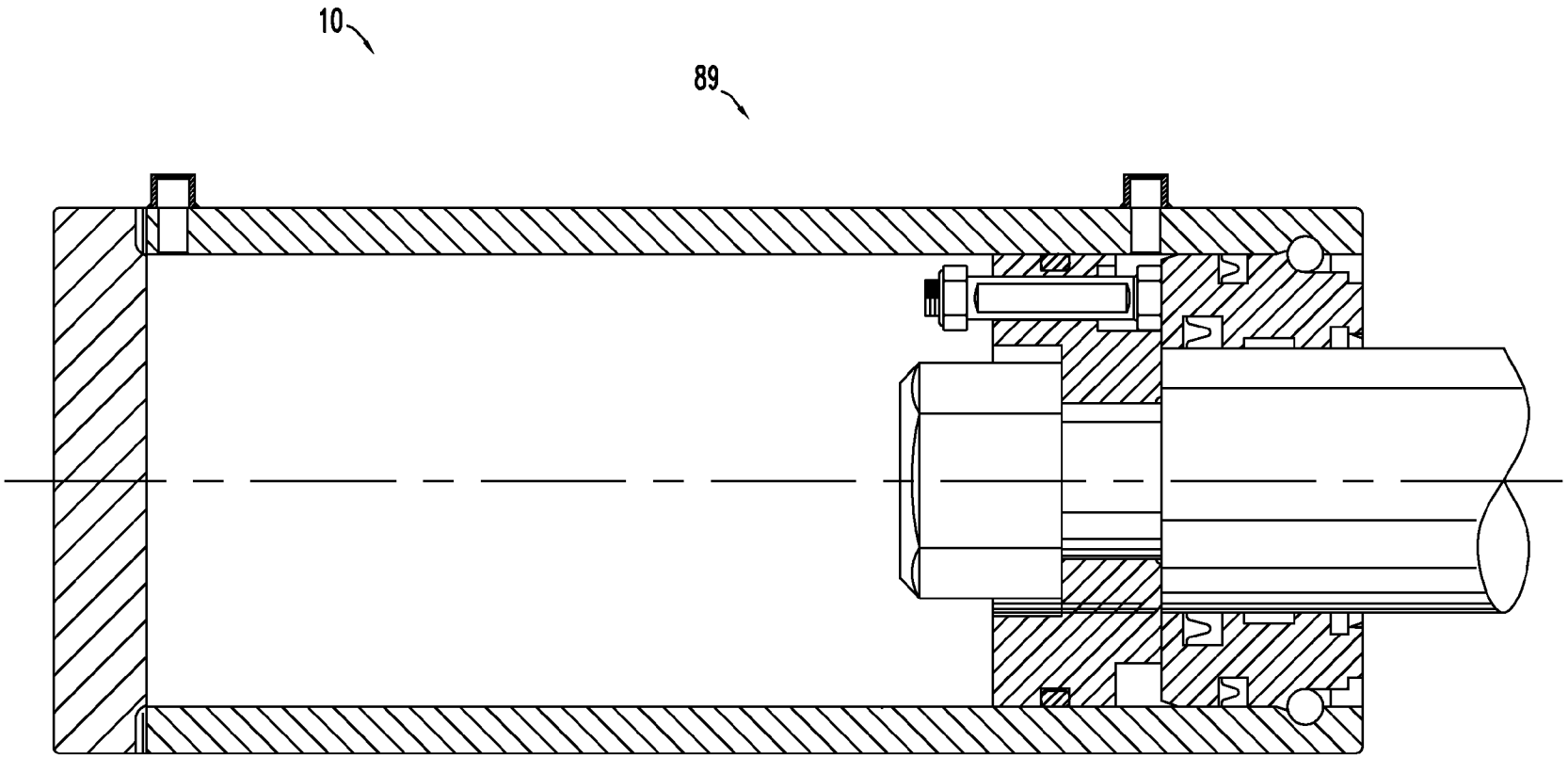
FIG. 10 is a side, cross-sectional view of the hydraulic cylinder 10 of FIG. 1 and shown in the fully extended (rearward) position 89.

Upon application of fluid pressure to the forward hydraulic chamber 81 through forward input port 19, piston head 21 and piston rod 12 are biased rearwardly (to the right in FIG. 8), as is shank 50 and rearward head 52, whereby valve member 48 nearly instantaneously moves rearwardly, and head 51 seals against front face 25 and blocks further fluid flow through valve passageway 33. The angled, forward transition surfaces 71 and 73 cooperate to smooth (lessen) the abrupt impact force of valve member 48 closing against front face 25. In similar fashion, with greater hydraulic pressure applied to forward hydraulic chamber 81 than to rear hydraulic chamber 82, piston rod 12 and piston head 21 move rearwardly until rearward head 52 contacts and is stopped by gland 18. Further rearward movement of rod 12 and head 21 unseats forward head 51 from piston head 21, and the higher fluid pressure in rear hydraulic chamber 82 is relieved into forward hydraulic chamber 81. The impact of piston head 21 against gland 18 is consequently lessened. Shown in FIG. 10 is hydraulic cylinder 10 in the fully extended (rearward) position 89.

Figure 11:
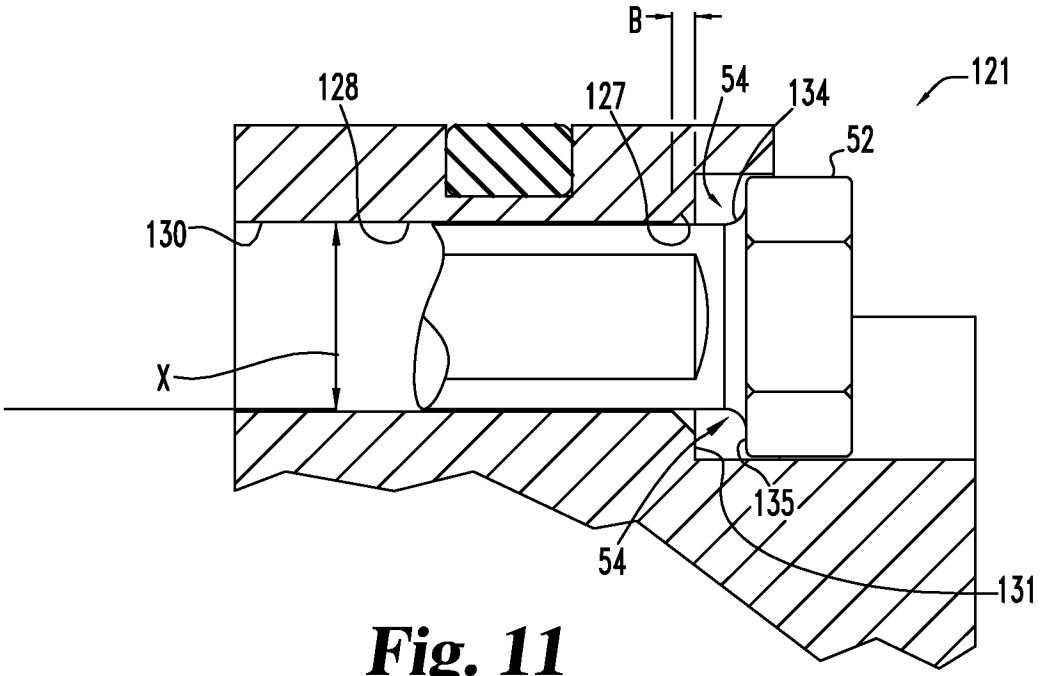
FIG. 11 is a side, cross-sectional view of the piston head 121 of a hydraulic cylinder in accordance with an alternative embodiment of the present invention.

Referring to FIG. 11, there is shown a piston head 121 in accordance with an alternative embodiment of the present invention. Piston head 121 is identical to the piston head 21 of FIG. 4, except as described herein, and like reference numbers are used for identical elements. Referring to the piston head 21 (FIG. 4), the transitional rim 123 at the junction between the cylindrical wall 125 of main bore 42 and the annular bottom surface 44 is shown as being radiused to closely match and mate with the radiused junction 54 of valve member 48. Such closely mating profiles of rim 123 and junction 54 provide desirable sealing engagement between piston head 21 and valve member 48 and a desirable output force curve at the region corresponding to the closing of valve passageway 33 by rearward head 52.

In the embodiment of FIG. 11, the transitional rim 127 at the junction between the cylindrical wall 128 of main bore 130 and annular bottom surface 131 is chamfered instead of radiused. The curved surface 134 of the radiused junction 54 is sized sufficiently less than the chamfer profile (at 127) so that the rearward, annular surface 135 of head 52 can seat flat against annular bottom surface 131 without the any of the curved surface 134 contacting any of the piston 21 proximal the chamfered, transitional rim 127, thus avoiding mushrooming or other damage to either transitional rim 127 or curved surface 134. In one embodiment, the diameter X of main bore 130 is 0.375 inches; the chamfer of rim 127 is at a 45 degree angle to cylindrical wall 128; the short side dimension B of the isosceles triangle for which transitional rim 127 is the hypotenuse is between about 0.088 and 0.100 inches (and preferably about 0.090 inches); and, the radius of the curved surface 134 is 0.086 inches. Alternative embodiments are contemplated wherein the dimensions of chamfered surface (transitional rim) 127 and curved surface 134 vary from the foregoing example, but a close tolerance between chamfered surface 127 and curved surface 134 is desired.

Alternative embodiments are contemplated wherein passageway 33 does not have a circular cross-section, as shown in FIG. 5, but instead has a non-circular cross-section. The corresponding valve member has a complementary configuration to freely reciprocate therein between fluid-flow sealing extended and retracted positions, and has flats creating relief channels, as with the valve member 48 herein, to permit relief of hydraulic pressure from one of chambers 81/82 to the other when the piston head nears one of the end cap 17 and gland 18.

Alternative embodiments are contemplated wherein the nut 38 has a smaller profile—that is, it does not extend as far forward from the front face 25 of piston 21—or is non-existent (piston rod 12 is threaded connected directly into piston 21). In this configuration, the leading end 85 of valve member 48, when in the rearward closed position 87, bottoms out against end cap 17 instead of the nut 38, which can result in damage or failure to valve member 48. In this embodiment, piston 21 is provided with a counterbore (not shown) defined in the front face 25 and at the opposite, forward end of, and coaxial with valve passageway 33. The leading end 85 of valve member 48 can then seat within that counterbore to provide clearance for and allow piston 21 to bottom out against end cap 17 instead of valve member 48.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A hydraulic cylinder:

a cylinder assembly having a cylinder, defining an inner hydraulic chamber and being for reciprocating receipt of a piston and piston rod therein;

a piston rod extending from the inner hydraulic chamber exteriorly of the cylinder;

a piston head assembly connected with said piston rod and disposed for reciprocation within said cylinder assembly, said piston head assembly comprising:

a piston head, and a valve assembly including a passageway defined in the piston head and a valve member having an outer surface and being sized and configured for reciprocation in the passageway between extended and retracted positions therein, the valve member having a shank axis and at least one flat defined along the outer surface and at least one transition surface between the outer surface and the flat, the transition surface forming an angle with the flat of less than 90 degrees, and wherein said at least one flat includes two flats that are mutually parallel, the valve member has a central shank with a diameter and a shortest distance D between the two flats, and the valve member has a proportion of shank diameter to distance D of 0.37 to 0.28.

2. The hydraulic cylinder of claim 1 wherein the two flats are symmetrical about a plane passing through the shank axis.

* * * * *